US008191886B2

(12) United States Patent
Bluethgen

(10) Patent No.: US 8,191,886 B2
(45) Date of Patent: Jun. 5, 2012

(54) DIVIDING PRINT JOBS IN OUTPUT TRAY

(75) Inventor: Soenke Christian Bluethgen, Ploen (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/253,093

(22) Filed: Oct. 5, 2011

(65) Prior Publication Data

US 2012/0038097 A1 Feb. 16, 2012

Related U.S. Application Data

(63) Continuation of application No. PCT/EP2010/054157, filed on Mar. 30, 2010.

(30) Foreign Application Priority Data

Jun. 4, 2009 (DE) ..... 10 2009 016 583

(51) Int. Cl.
*B65H 33/04* (2006.01)

(52) U.S. Cl. ..... 270/58.32; 270/58.31; 270/58.07; 270/58.11

(58) Field of Classification Search ..... 270/58.07, 270/58.11, 58.31, 58.32; 493/350, 353, 379, 493/390, 392, 393, 394; 83/176; 281/26
See application file for complete search history.

(56) References Cited

U.S. PATENT DOCUMENTS

| | | | | |
|---|---|---|---|---|
| 5,024,643 | A * | 6/1991 | Kastner | 493/351 |
| 5,447,402 | A * | 9/1995 | Kobayashi | 412/33 |
| 5,628,502 | A | 5/1997 | Amarakoon | |
| 5,655,207 | A | 8/1997 | Sugiyama et al. | |
| 6,652,051 | B1 | 11/2003 | Kokkas | |
| 7,050,725 | B2 | 5/2006 | Jingu | |
| 2011/0233843 | A1 * | 9/2011 | Shiraishi | 270/58.09 |
| 2011/0233844 | A1 * | 9/2011 | Shiraishi et al. | 270/58.11 |

FOREIGN PATENT DOCUMENTS

| | | | |
|---|---|---|---|
| EP | 1 486 831 | A1 | 12/2004 |
| JP | 2000318918 | A * | 11/2000 |

* cited by examiner

*Primary Examiner* — Leslie A Nicholson, III

(74) *Attorney, Agent, or Firm* — Christopher J. White

(57) ABSTRACT

A method for dividing print jobs in an output tray of a printing machine includes outputting print job sheets of a print job onto an inclined support of the output tray, so that the print job sheets slide against an abutment to form a stack. A dividing sheet is produced, and a hook-shaped deformation is imparted in the dividing sheet. The dividing sheet is outputted onto the stack formed by the print job sheets on the output tray so that the dividing sheet slides in the direction of the abutment and the deformation becomes propped up against the stack.

12 Claims, 4 Drawing Sheets

DIVIDING PRINT JOBS IN OUTPUT TRAY

CROSS-REFERENCE TO RELATED APPLICATIONS

This application is a continuation of International Patent Application No. PCT/EP2010/054157, with an international filing date of Mar. 30, 2010 which is incorporated herein by reference in its entirety.

This application is co-filed with and has related subject matter to U.S. patent application Ser. No. 13/253,095, filed Oct. 5, 2011

FIELD OF THE INVENTION

The invention relates to dividing print jobs for a sheet-processing machine, in particular for a printing machine.

BACKGROUND OF THE INVENTION

When printing different or identical print jobs that are printed in multiple copies, it is desirable to separate said print jobs for the user at the delivery point and to identify where one print job ends and the next one starts. Regarding this, several possibilities for dividing jobs are known.

For example, a dividing sheet can be interposed between print job sheets that are to be placed on top of each other, the format of said dividing sheet being different from the format of the print job sheets that are to be divided, and, in particular, having a larger format. In order to ensure an automated operation of the printing machine, it is practical to transport said dividing sheets out of a feeder that is located in the printing machine. Inasmuch as, however, the dividing sheets must be different from the format of the print jobs to be generated, a feeder is now loaded with dividing sheets that do not participate in the value-added function of the print job, but occupy a feeder and thus lower the productivity of the printing machine because—as a result of the reduced number of usable feeders—the remaining feeders must be loaded more frequently.

Furthermore, there is the possibility of transporting print jobs to an output tray module that consists of several trays arranged in a fan-like manner and that receives a single print job in each tray as is known, for example, from copiers. An output tray that is configured in this manner is significantly more expensive and more susceptible to paper jams than a simple plate-like tray. In addition, due to the number of fan-like arranged plate-like trays in a relatively confined space, their respective stacking height is limited, thus impairing the output of large print jobs in view of the number of pages.

Furthermore, it has been known to move lateral guides of an output tray in lateral direction in order to guide individual print jobs into an end position on the output tray that is different from that of the previous job. On the one hand, such a modification is expensive and, on the other hand, it involves problems in view of the use of an additional substrate and format range of the printing sheet.

Beyond that, it is possible to use another type of output tray, e.g., a rotating or oscillating tray that, due to its principle of operation, allows the sheets to be shifted transversely to their transport direction. These output trays can fulfill the function of the print job division using an offset function, as it were; however, they are significantly more expensive than a plate-like output tray.

Consequently, it is the object of the present invention to simply divide different or identical print jobs that are to be successively fed to a plate-like output tray of a sheet printing machine.

SUMMARY OF THE INVENTION

According to an aspect of the invention, there is provided a method for dividing print jobs in an output tray of a printing machine, the method comprising:

outputting print job sheets of a print job onto an inclined support of the output tray, so that the print job sheets slide against an abutment to form a stack, producing a dividing sheet;

imparting a hook-shaped deformation in the dividing sheet; and outputting the dividing sheet onto the stack formed by the print job sheets on the output tray so that the dividing sheet slides in the direction of the abutment and the deformation becomes propped up against the stack.

In various embodiments, a method is provided for dividing print jobs in an output tray of a printing machine, wherein, when a print job is running, the sheets are initially output onto an inclined support of the tray, and the sheets subsequently slide against an abutment of the output tray. Upon completion of the print job and before running the next print job, a dividing sheet is placed on the stack of sheets located in the output tray, whereby, before the output of the dividing sheet, said dividing sheet is imparted with a hook-shaped deformation so that it is possible for the deformation of the dividing sheet to be propped up against the stack formed by the previous print job. As a result of this, the dividing sheet projects from the remaining sheets of the stack underneath and allows an easy identification of the end of the print job. The dividing sheet also projects from the sheets of a print job that is subsequently deposited thereon and thus marks a clear separation between said print jobs. The ejection of a dividing sheet can occur between a plurality of successive print jobs.

Preferably, when being delivered to the output tray, the dividing sheet overshoots the stack that has been previously formed by delivered sheets and subsequently slides back in the direction of the abutment. The hook-shaped deformation of the dividing sheets is then propped up against the stack when said deformation comes into contact with a stack edge and prevents a further sliding back.

The hook-shaped deformation in the dividing sheet can be imparted in the center, for example, in order to ensure that the dividing sheet is securely held and in order to prevent the dividing sheet from shifting relative to the stack of sheets underneath.

Inasmuch as, directly upon leaving the sheet path, some plate-like output trays slow down the sheets with an actively controlled pair of rollers in order to improve stack accuracy, it can be necessary to decelerate less severely the sheets that have been deformed into dividing sheets, so that the hook-shaped deformation can reliably overshoot a stack edge formed under said deformation. By imparting the hook-shaped deformation it is thus prevented that the sheet descending on the plate-like tray slides back up to a stack guiding plane. Thus, the dividing sheet projects beyond the stack of the previous print job below said dividing sheet and also projects beyond the stack of the subsequent print job to be formed thereon.

Furthermore, the sheet that is to be deformed can be printed in an information field addressed to the user, where the information field printed on the sheet can contain information regarding, for example, a job name, an edition, or a sheet property, etc. Preferably, the format of the dividing sheet is the same as the format of the other sheets used for print jobs. Therefore, the sheet used as the dividing sheet can be transported out of the same or out of another feeder using the same sheet format. Therefore, there is no need to transport the dividing sheets out of a separate, specifically provided feeder of the printing machine. As a result of this, improved productivity of the printing machine is achieved.

The hook-shaped deformation in the dividing sheets is preferably imparted offset relative to transport rollers of the printing machine, for example between adjacent pairs of transport rollers, in a direction transverse to the sheet transport direction. This ensures that the hook-shaped deformation imparted by the punch-type deforming unit in the dividing sheet does not come into contact with the transport rollers when the dividing sheet is delivered. Therefore, the hook-shaped deformation of the dividing sheet retains its shape during the output of the dividing sheet onto the output tray, so that the dividing sheet can be propped up against the stack formed by the previous print job.

In addition, the hook-shaped deformation can also be imparted during and with the movement of the dividing sheet. This can, for example, allow a reduction of the speed with which the punch-type deforming unit must be moved back and forth without impairing a movement of the sheet to the tray. The required speed of movement of the punch-type deforming unit results from the sheet velocity along the sheet path of the printing machine. As a rule, a deceleration of the sheet due to the punching and deforming operation is not desirable. Due to the movement of the punch-type deforming unit with the movement of the dividing sheet in transport direction, the punching and deforming operation can thus take place at a speed that is lower than that of a strict back-and-forth movement of the punch-type deforming unit in a direction orthogonal to the dividing sheet.

In accordance with one embodiment of the present invention, the hook-shaped deformation can be imparted in the dividing sheet using a rotating punch-type deforming unit, said unit being rotated synchronously with the sheet velocity, for example, when the punching and deforming operation is being performed.

Alternatively, in accordance with a further embodiment of the present invention, the hook-shaped deformation can be imparted in the dividing sheet by using a punch-type deforming unit that can be moved back and forth. In addition to the back-and-forth movement, such a punch-type deforming unit could also perform a movement in sheet transport direction.

Furthermore, in accordance with a preferred embodiment of the present invention, a device for dividing print jobs for a printing machine is provided, said device being an integral part of a sheet path of the printing machine and comprising a punch-type deforming unit with a stamp for punching and deforming a partial area of a sheet.

For example, the stamp can be coupled with an electric or pneumatic drive for the punching movement. A matrix can be provided under the stamp, said matrix acting as a counter-part to the stamp and thus allowing precise punching and deforming of the sheets. However, there need not necessarily be a matrix. Due to the fact that the sheets in the printing machine usually are held in place by transport rollers on both sides, the sheets exhibit a tension that makes it possible to punch and deform the sheets even with the application of only the stamp provided therefor.

Preferably, the stamp has at least one cutting edge. If the stamp is provided with only one cutting edge, the dividing sheet can be cut not in the middle but on the sides, and can subsequently be deformed. In accordance with a preferred embodiment of the present invention, the stamp is V-shaped. However, it is also conceivable that the stamp has a shape that is different therefrom, as long as the deformed partial area forms a hook and remains on the sheet, i.e., is not punched out completely.

The punch-type deforming unit can be configured in such a manner that it performs a linear back-and-forth movement in order to perform the punching operation. In order to avoid a delay caused by the punch-type deforming unit during the punching and deforming operation, it is advantageous if the punching operation is very short, this being achievable, for example, with the use of a piezo element.

In addition, it can be possible, for example, to move the punch-type deforming unit in sheet transport direction as well as in a direction orthogonal to a sheet plane. As a result of this, it is possible to synchronize the movement of the punch-type deforming unit with the sheet speed. This makes it possible, for example, to reduce the speed with which the punch-type deforming unit must be moved back and forth during the punching and deforming operation. The required speed of movement of the punch-type deforming unit results from the sheet velocity along the sheet path of the printing machine. As a rule, a deceleration of the sheet due to the punching and deforming operation is not desirable in this instance. Due to the movement of the punch-type deforming unit with the movement of the dividing sheet in transport direction, the punching and deforming operation can thus take place at a lower speed than with a strictly back-and-forth movement of the punch-type deforming unit in a direction orthogonal to the dividing sheet.

Alternatively, the punch-type deforming unit can comprise a rotatable element such as, for example, a roller with the stamp being provided on said roller. Preferably, the rotatable element can be rotated synchronously with the sheet transport speed—via a corresponding drive—when the punching and deforming operation is performed. The rotatable element has a starting position or idle position, in which the sheet can freely pass and in which it is positioned when no punching operation is being performed. If a punching operation is performed, the punch-type deforming unit is activated by the machine control in such a manner that the punch-type defaming unit initiates the punching operation, that the stamp arranged on the punch-type deforming unit rotates in synchrony with the sheet speed and punches, as well as deforms, the sheet at the desired position. For example, a partial area of the roller can be recessed in the form of a segmented roller, so that, depending on the position of the roller, said roller does not come into contact with the sheet when running a print job.

Preferably, the punch-type deforming unit is offset relative to the transport rollers of the printing machine and is arranged, in particular, between adjacent pairs of transport rollers transversely to the sheet transport direction. This ensures that the hook-shaped deformation imparted by the punch-type deforming unit will not come into contact with the transport rollers when the dividing sheet is being delivered. The hook-shaped deformation of the dividing sheet thus retains its shape when said dividing sheet is being delivered to the output tray, so that the dividing sheet can be propped up against the stack formed by the previous print job.

In various embodiments, a device for dividing print jobs is contained in a sheet printing machine, said machine comprising downstream of the device for dividing print jobs—a plate-like output tray with an incline as well as with an abutment.

BRIEF DESCRIPTION OF THE DRAWINGS

In the detailed description of the preferred embodiments of the invention presented below, reference is made to the accompanying drawings, which are not necessarily to scale, in which.

DETAILED DESCRIPTION OF THE INVENTION

Figure 1:
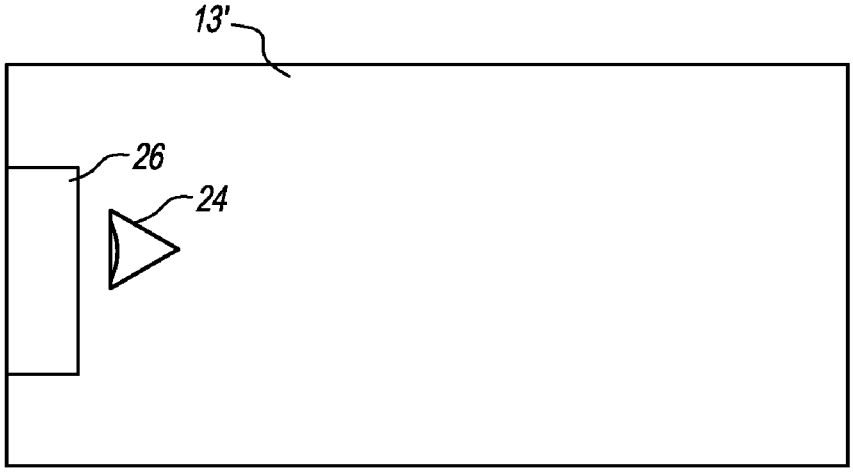
FIG. 1 is a plan view of a dividing sheet having a partial area that is partially punched out and bent in a hook-shaped manner.

Location and directional indications used in the description hereinafter primarily relate to the illustrations in the drawings and should thus not be viewed as being restricting. However, they can also relate to a preferred final arrangement.

Figure 7:
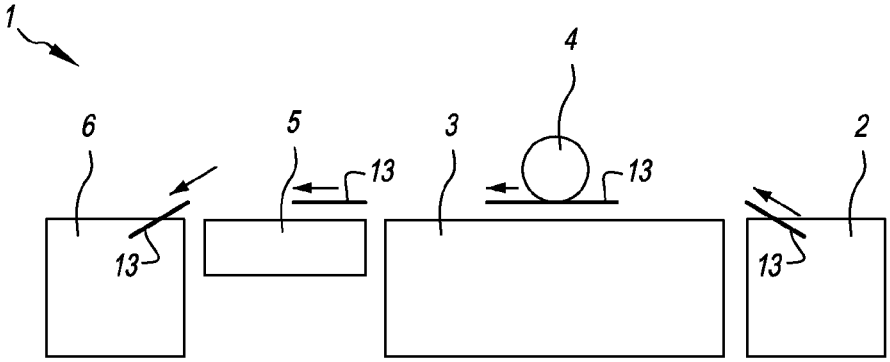
FIG. 7 is a side view of a sheet printing machine.

FIG. 7 shows a schematic side view of a sheet printing machine 1 that comprises a feeder 2, a transport device 3, a printing unit 4, a fusing unit 5 and an output tray 6.

The feeder 2 can be of any type that is able to feed individual sheets to the transport device 3. Of course, it is also possible to provide several feeders 2 in order to be able to feed different sheets 13 to the transport device 3, for example. The transport device 3 comprises a suitable unit for receiving the fed sheets and for transporting said sheets past the printing unit 4 in order to allow printing the sheet. The unit can comprise a circulating transport belt, in the known manner, to which belt the sheet can be affixed electrostatically. The printing unit 4 can be any printing unit such as, for example, an electrophotographic printing unit or also an inkjet printing unit. Although only one printing unit 4 is shown, it is possible, for example, to also provide several printing units 4 adjacent to the transport device 3. The fusing unit 5 is of a type suitable for fusing or drying printing medium applied to a sheet, before said sheet is fed to the output tray 6.

Figure 3:
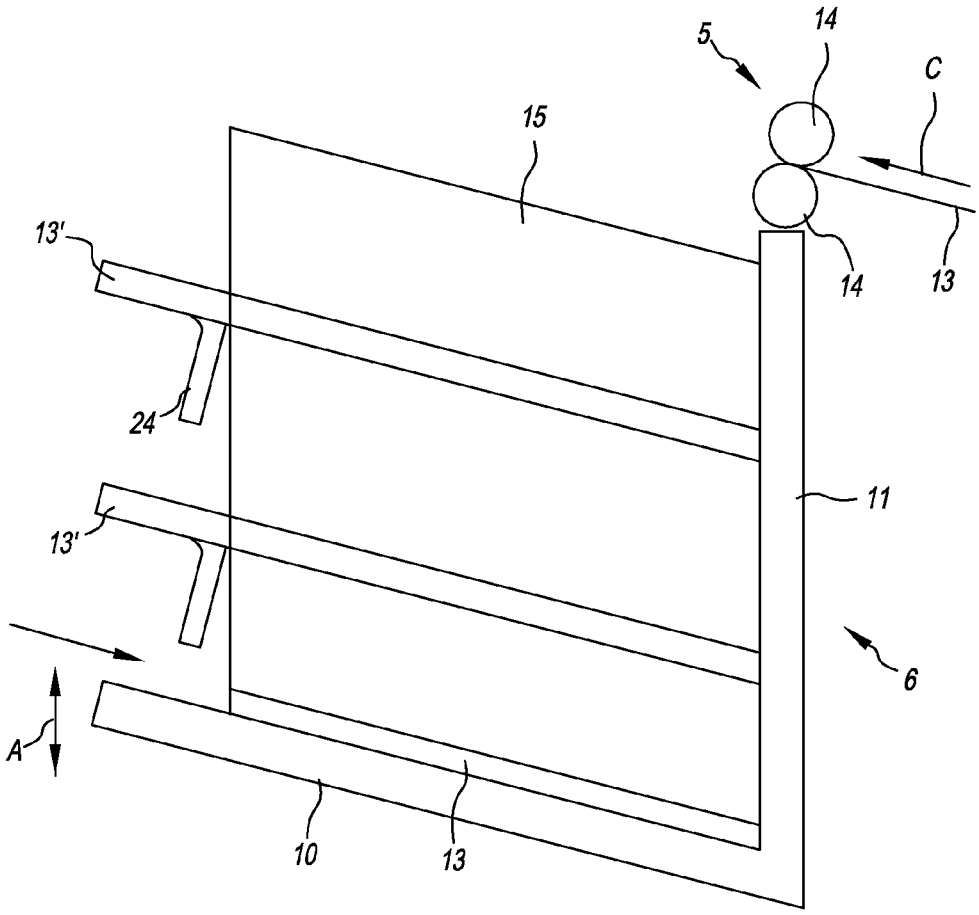
FIG. 3 is a side view of a plate-like output tray loaded with three different print jobs that are separated by two different dividing sheets as in FIG. 1.
Figure 6:
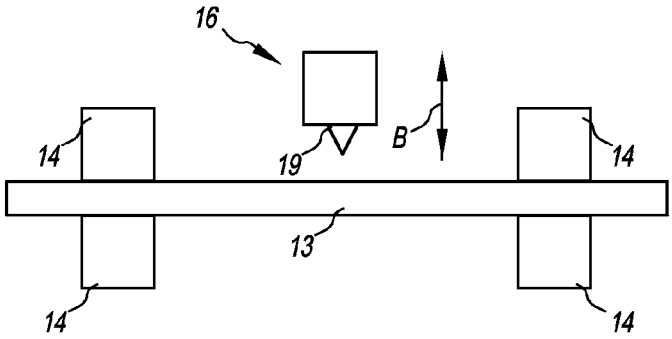
FIG. 6 is a cross-sectional view of the punch-type deforming unit as in FIG. 4, to show how said unit is arranged in a sheet path of a printing machine.

FIG. 3 shows output tray 6, plate-like output tray. The output tray 6 has an inclined support 10 that can be moved up and down by using a not-specifically-illustrated lifting mechanism, as indicated by the double arrow A. Furthermore, the output tray 6 of the printing machine 1 has an abutment 11 arranged adjacent to the support 10. The support 10 is inclined toward the abutment 11, so that a sheet 13 located on the support 10 slides against the abutment 11, as indicated in FIG. 3. Furthermore, above the abutment 11, the output tray 6 comprises pairs of transport rollers 14 that, between them, form a transport nip for the sheets 13, as shown in FIG. 3. As shown in FIG. 6, two pairs of transport rollers 14 are provided, said rollers being disposed to receive and transport a sheet 13 between them in order to transport said sheet out of the printing machine 1 and onto the support 10 in the direction of the arrow C.

Figure 4:
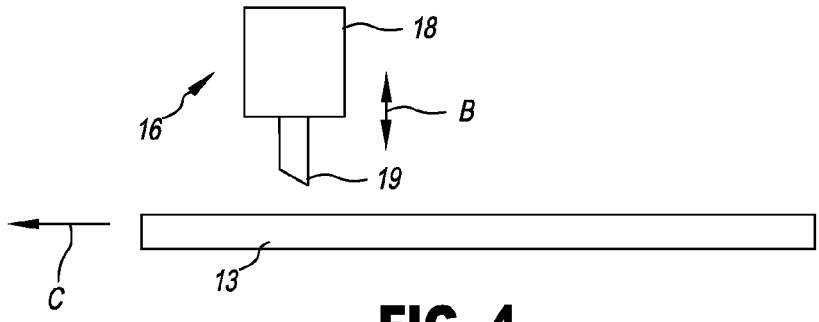
FIG. 4 is a side view of a punch-type deforming unit in accordance with a first embodiment of the present invention.

In addition, the output tray comprises a punch-type deforming unit 16 that is indicated, for example, in FIG. 6, and that is arranged between the pairs of transport rollers 14. FIG. 4 shows a first exemplary embodiment of the punch-type deforming unit 16 that comprises a drive element 18 and a stamp 19. The stamp 19 can be moved up and down via the drive element 18, as is indicated by the double arrow B in FIG. 4. The stamp is arranged in such a manner that, when it is moving downward, it crosses the path of movement of a sheet defined by the transport rollers 14. To do so, the drive element 18 can comprise, for example, a pneumatic or piezo drive for the stamp 19. Of course, also other drives are conceivable.

If, during the downward movement, a sheet 13 is located under the stamp 19, a partial area of the sheet 13 is punched out and bent. In so doing, the partial area is always punched out in such a manner that it remains in contact with the sheet along a line of contact. To do so, the stamp 19 has—in a suitable manner—two blades that are arranged relative to each other so as to form a V-shape, said blades punching out the partial area of the sheet 13 along two straight lines, and has an area located between the blades that ensures that the punched-out partial area is being bent. It is also possible to optionally arrange a matrix below the stamp 19, said matrix acting as a counter support for the sheet and ensuring reliable punching. Subsequently, such a sheet with a punched out and bent partial area can be used as the dividing sheet 13, 13' as will still be explained in detail hereinafter.

Figure 2:
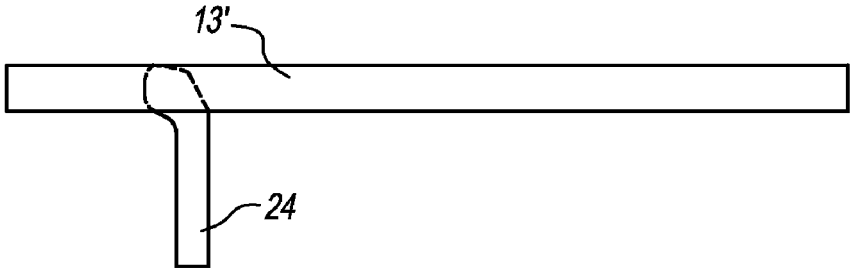
FIG. 2 is a side view of the sheet as in FIG. 1.

FIG. 1 and FIG. 2 show a schematic plan view and a schematic side view, respectively, of such a dividing sheet 13' with a partial area that has been punched out in the above-described manner, said partial area having been bent into a hook-shaped deformation 24. The deformation 24 is provided in the center, viewed in transverse direction of the dividing sheet 13'. Of course, the deformation can also be provided away from the center of the dividing sheet 13' when viewed in transverse direction. In any event, the deformation 24 should be provided so as to be offset relative to the pairs of transport rollers 14 in transverse direction of the sheet 13, so that said deformation is not being reformed by the transport rollers. In longitudinal direction, the deformation 24 is provided in the front end region, viewed in transport direction of the dividing sheet (indicated by the arrow C in FIG. 1). Preferably, the deformation should be in the front third and, in particular, in the front fourth, of the sheet. An information field 26 is indicated between the front end of the sheet and the deformation 24, where information can be printed on, for example, about a print job (prior to the punching and deforming operation).

Figure 5:
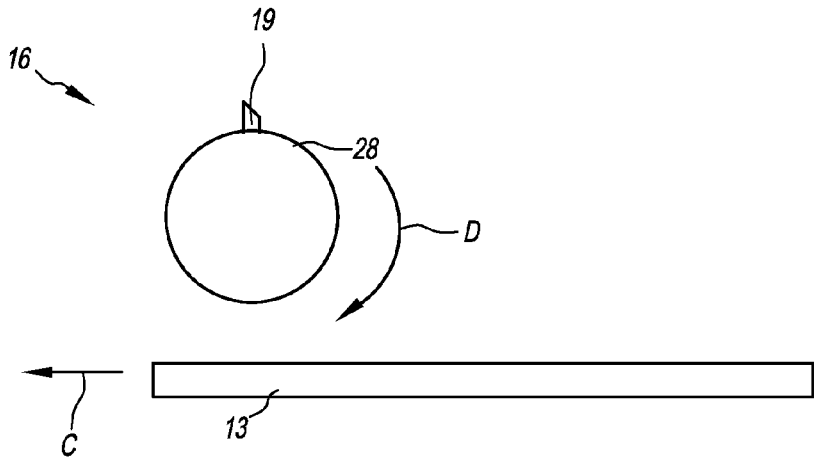
FIG. 5 is a side view of a punch-type deforming unit in accordance with another embodiment of the present invention.

FIG. 5 shows an alternative embodiment of the punch-type deforming unit 16, where the same reference numerals as in FIG. 4 are used for the same or similar elements. Again, the punch-type deforming unit 16 comprises a drive element 18 and a stamp 19 that essentially can have the same configuration as that of FIG. 4. The drive element 18 comprises a roller 28 that is provided with the stamp 19 on its outside circumference. The roller 28 can be selectively rotated via a corresponding drive (not illustrated), as is indicated by the arrow D. The roller 28 has a starting or idling position, in which the stamp 19 is positioned outside the path of movement of a sheet 13, so that said sheet can be freely transported underneath and past the roller 28 when no punching operation is to be performed. However, due to a selective rotation of the roller 28, it is also possible for the stamp 19 to plunge into a sheet 13 in order to again punch out and deform a partial area of said sheet. Subsequently, the sheet can be used as the dividing sheet 13'.

Hereinafter, the operation of the printing machine 1 and, in particular, a method for dividing print jobs will be explained in detail with reference to the figures.

Referring back to FIG. 7, first, the sheets 13 are transported out of the feeder 2 and past the printing units 4 of the printing machine 1 where they are printed in accordance with a print job. Such a print job can have a random number of sheets that are either identically or differently printed, as is known in the art. After printing the sheets, they are guided through the fusing unit 5 where a printing medium is fused in the known manner, and the sheets are subsequently transported to the output tray 6.

Referring back to FIG. 3, the sheets 13 are ejected via the transport rollers 14 onto the inclined support 10 in such a manner that they land on the support 10 at a certain distance from the abutment 11 and then slide against the abutment 11 and, in so doing, form a stack 15. Following the sheets of a print job (defined by the prespecified number of sheets that are to be considered one print job), another sheet 13 that is to act as the dividing sheet 13' is transported out of the feeder 2 (FIG. 7) past the printing units 4 (FIG. 7) and is optionally printed in an information field 26 (FIG. 1). After potential fusing of printing medium in the fusing unit 5 (FIG. 7), the sheet 13 is transported to the output tray 6 (FIG. 7).

Referring back to FIG. 4, in the region of the output tray 6 (FIG. 3), the punch-type deforming unit 16 is then activated via a corresponding control unit in such a manner that the stamp 19 plunges into the sheet 13, thus punching out and deforming a corresponding partial area of said sheet in order to generate a dividing sheet 13' (FIG. 3) with a deformation 24 (FIG. 3). This punching operation preferably occurs while the sheet 13 is moved, without stopping the sheet, past the punch-type deforming unit 16. Therefore, in the embodiment in accordance with FIG. 4, the up-and-down movement of the stamp 19 should be carried out with appropriate speed in order to avoid a hold-up in the movement of the sheet, if at all possible, or to at least reduce the risk of such a hold-up. To do so, the stamp could optionally perform a lateral movement with the movement of the sheet 13 in addition to the strict up-and-down movement. In the embodiment comprising the rotating stamp 19 (FIG. 5), the rotation should be performed as synchronously as possible with a movement of the sheet 13. It is also possible to slow the transport speed of the sheet 13 for the punching and deforming operation and to subsequently again accelerate the sheet for the output onto the support 10 (FIG. 3).

Referring back to FIG. 3, the dividing sheet 13' is then ejected via the transport rollers 14 onto the so-far-formed stack 15 of sheets 13 of the previous print job so that the deformation 24 is moved beyond a front edge of the stack 15. Subsequently, the dividing sheet slides back in the direction of the abutment 11, whereupon the deformation 24 becomes hooked on one side of the stack 15 of sheets 13 of the previous print job, so that a complete sliding-back of the dividing sheet 13' against the abutment is prevented. As a result of this, the dividing sheet 13' projects by a certain distance from the stack 15 of sheets 13 of the previous print job, thus marking the end of said print job. Following that, a new print job can be started, where the sheets 13 of this new print job are again processed in the above-described manner and transported to the output tray 6. There, they are again placed on the so-far formed stack 15 in such a manner that the sheets 13 slide against the abutment 11. FIG. 3 shows a situation in which the sheets 13 of three print jobs are divided by appropriate dividing sheets 13'. As is obvious from FIG. 3, the optionally printed information field 26 of the dividing sheet 13' projects with respect to the rest of the stack 15, so that an operator can easily detect printed information regarding the print job here.

The above description makes it clear that the same sheets can be used for the dividing sheets 13' as can be used for the print jobs. By punching and deforming a partial area of the sheets and by a corresponding output onto an inclined support 10 of the output tray 6, it is possible to reliably mark the divisions between print jobs.

Referring back to FIG. 1, in various embodiments, the stamp 19 can have a different shape, so that the partial area is not punched on two sides and bent along a third side into the deformation 24. For example, instead of two blades arranged in a V-shape, the stamp can also have three blades to form a U-shape. It is only important that the partial area is not punched out completely and allows deformation. For example, in the region of the lateral edges of a sheet 13, a single cut can be sufficient in order to allow the deformation of a partial area of the sheet. It is also possible to provide more than one punch-type deforming unit 16 in order to be able to provide several deformations 24 within a sheet. Although the support 10 (FIG. 3) is inclined in such a manner that the sheets slide back against their delivery direction through the transport rollers, it is also possible for the support to have a different inclination, so that the sheets slide, for example, transversely to the delivery direction against a corresponding abutment, so that the deformation can be configured in an appropriately different manner (transverse to the ejection direction). Furthermore, it should be noted that compatible features of the different embodiments can be combined with each other or be exchanged for each other.

Although the present invention has been described in detail with exemplary embodiments, the invention is not restricted to the above-described embodiments. A person skilled in the field of printing machines could perform various modifications within the scope of this invention.

The invention has been described in detail with particular reference to certain preferred embodiments thereof, but it will be understood that variations and modifications can be effected within the spirit and scope of the invention.

PARTS LIST

1 sheet printing machine
2 feeder
3 transport device
4 printing unit
5 fusing unit
6 output tray
10 support
11 abutment
13 sheet
13' dividing sheet
14 transport rollers
15 stack
16 punch-type deforming unit
18 drive element
19 stamp
24 hook-shaped deformation
26 information field
28 roller
A arrow
B arrow
C arrow
D arrow

The invention claimed is:

1. Method for dividing print jobs in an output tray of a printing machine, the method comprising:

outputting print job sheets of a print job onto an inclined support of the output tray, so that the print job sheets slide against an abutment to form a stack, producing a dividing sheet;

imparting a hook-shaped deformation in the dividing sheet; and outputting the dividing sheet onto the stack formed by the print job sheets on the output tray so that the dividing sheet slides in the direction of the abutment and the deformation becomes propped up against the stack.

2. The method according to claim 1, wherein when the dividing sheet is output onto the output tray, the dividing sheet overshoots the stack formed by the print job sheets before sliding back in the direction of the abutment so that the hook-shaped deformation in the dividing sheet becomes propped up against one side of the stack in order to prevent a further sliding toward the abutment.

3. The method according to claim 1, wherein the hook-shaped deformation is imparted transversely to a sliding direction of the dividing sheet in the center relative to the abutment.

4. The method according to claim 1, wherein the hook-shaped deformation is imparted, in a sliding direction of the dividing sheet, in a rear third of the dividing sheet.

5. The method according to claim 1, further including printing the dividing sheet with an information field before outputting the dividing sheet to the stack, wherein the information field is located between an edge of the dividing sheet and the deformation.

6. The method according to claim 5, wherein the information field printed on the dividing sheet includes information regarding a job name, an edition, or a sheet property.

7. The method according to claim 1, wherein a format of the dividing sheet is the same as that of the print job sheets.

8. The method according to claim 1, further including transporting the dividing sheet at a sheet transport speed, wherein the hook-shaped deformation is imparted during the transport of the dividing sheet.

9. The method according to claim 8, wherein the imparting step includes imparting the hook-shaped deformation using a rotating stamp.

10. The method according to claim 9, further including rotating the stamp synchronously with the sheet transport speed.

11. The method according to claim 1, wherein the imparting step includes imparting the hook-shaped deformation using a stamp that is movable back and forth.

12. The method according to claim 1, wherein the hook-shaped deformation is imparted, in a sliding direction of the dividing sheet, in a front third of the dividing sheet.

* * * * *